United States Patent [19]

King

[11] Patent Number: 4,515,279

[45] Date of Patent: May 7, 1985

[54] DISPLAY SHELF CONSTRUCTION

[75] Inventor: Homer F. King, Elmhurst, Ill.

[73] Assignee: H. King & Associates, Ltd., Elmhurst, Ill.

[21] Appl. No.: 404,016

[22] Filed: Aug. 2, 1982

[51] Int. Cl.[3] ..... A47F 5/16

[52] U.S. Cl. ..... 211/153; 108/13; 211/90; 211/187; 211/49.1

[58] Field of Search ..... 211/134, 135, 90, 186, 211/187, 49 R, 153; 108/1, 13

[56] References Cited

U.S. PATENT DOCUMENTS

| | | | |
|---|---|---|---|
| 1,428,730 | 9/1922 | Weston | 108/1 |
| 1,830,815 | 11/1931 | Twait | 108/1 |
| 3,164,254 | 1/1965 | Gorc | 211/49 R X |
| 3,223,246 | 12/1965 | Daitch | 211/134 |
| 4,073,384 | 2/1978 | Celeste | 211/49 R X |

*Primary Examiner*—Robert W. Gibson, Jr.

*Attorney, Agent, or Firm*—Neuman, Williams, Anderson & Olson

[57] ABSTRACT

A removable display shelf is provided for being selectively mounted in either of two modes on at least a pair of spaced upright supports, the latter being positioned forwardly of an upright supporting member. The shelf includes a panel section having at least a portion thereof adapted to be disposed between a pair of upright supports. Provided on one surface of the panel section are first and second ramp sections. The first ramp section has an article-contacting surface extending angularly rearwardly from the panel section one surface. The second ramp section is positioned forwardly of the first ramp section and has an article-contacting surface extending angularly forwardly from the panel section one surface. When the shelf is in a first mode, the first and second ramp sections coact to support an article in an upwardly tilted position. The panel section includes a second surface provided with laterally spaced guide means between which an article is accommodated when the shelf is in a second mode. The shelf includes a supporting member-engaging end section extending angularly from the inner edge portion of the panel section, and support-attaching means spaced forwardly of the end section and coacting therewith to retain the shelf in either mode in a selected position on the upright supports.

14 Claims, 8 Drawing Figures

FIG. 2
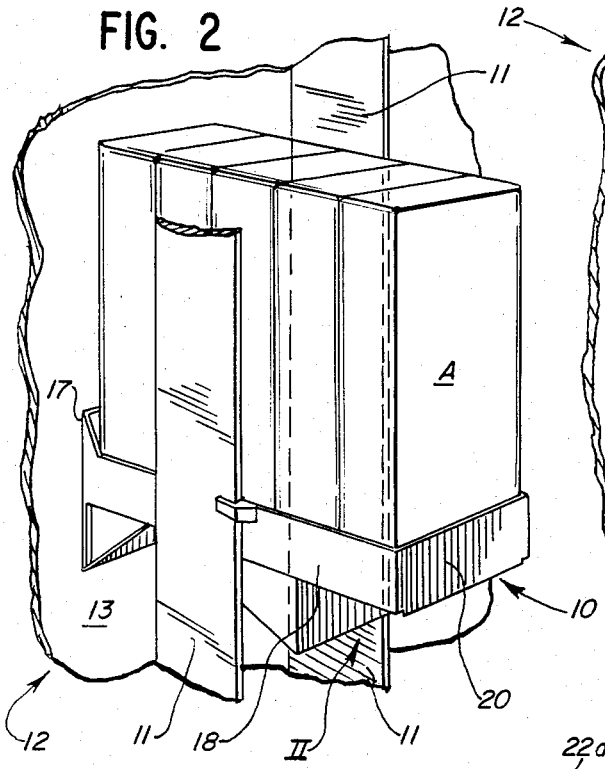
FIG. 1
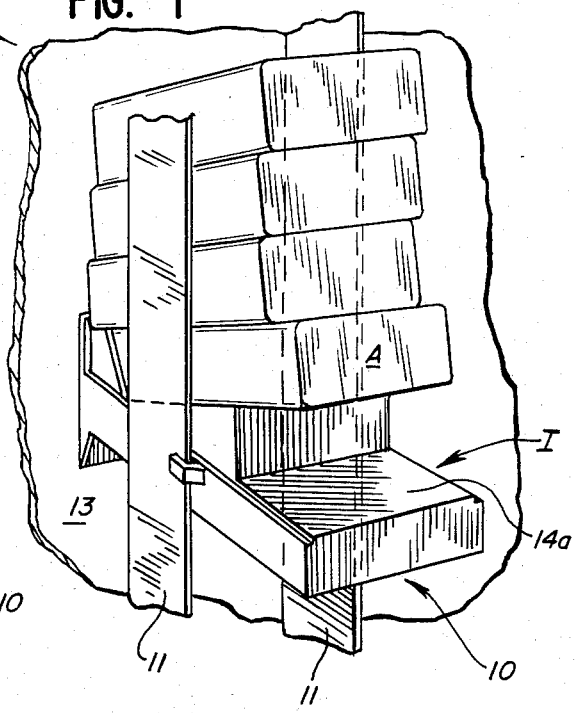
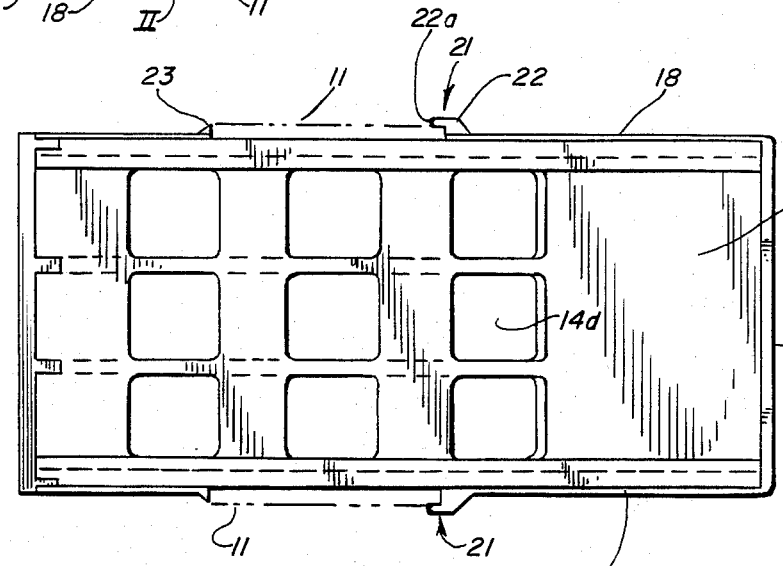
FIG. 3
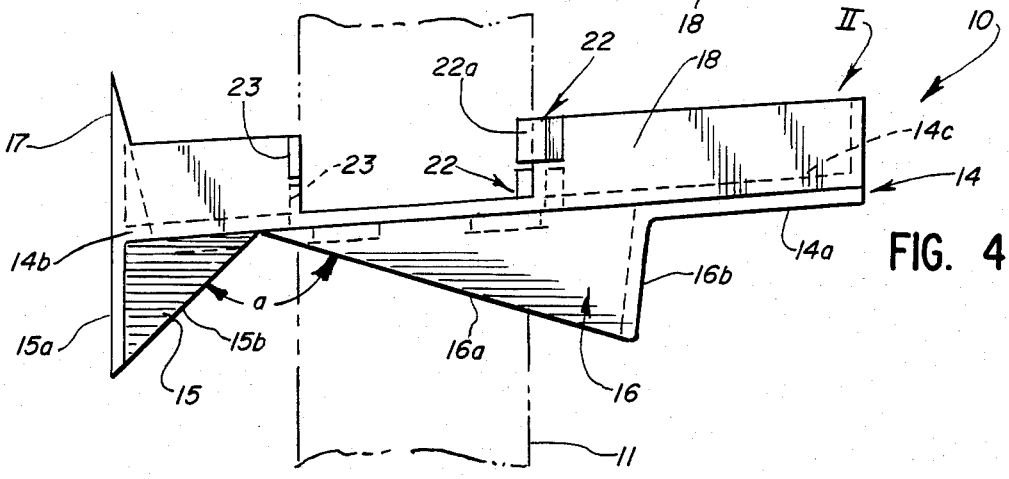
FIG. 4

DISPLAY SHELF CONSTRUCTION

BACKGROUND OF THE INVENTION

In the merchandising of various articles such as cigarettes or the like, they are frequently sold by the carton or individual packs. Thus, for convenience, it is desirable to attractively display both forms of the article in the same location and in such a way as to facilitate manual removing of the selected form of article from the display shelf without adversely disturbing the remaining articles on the shelf. Heretofore, in order to accommodate the various forms of articles it was necessary to have several variations of shelves and racks. Oftentimes such shelves and racks were beset with one or more of the following shortcomings: (a) they did not present an attractive eye-appealing display of the articles; (b) both hands of the clerk or customer were required to remove the selected article from the shelf; (c) the articles were supported in an unstable manner; and (d) the shelf consisted of numerous components whereby the assembly thereof was an awkward, frustrating and time-consuming manipulation.

SUMMARY OF THE INVENTION

Thus, it is an object of the invention to provide an improved display shelf which is not beset with any of the aforenoted shortcomings.

It is a further object to provide an improved display shelf which is of simple, inexpensive, one-piece construction, and is adapted to be mounted in either of two modes to effectively accommodate and support in an attractive manner a variety of articles in various forms.

It is a further object to provide an improved display shelf which may be mounted in a selected position on upright supports without the need for tools or special fastening devices.

Further and additional objects will appear from the description, accompanying drawings, and appended claims.

In accordance wih one embodiment of the invention a display shelf is provided for mounting in either of two modes in selected positions on laterally spaced upright supports. The shelf includes a panel section having an inner portion disposed intermediate adjacent upright supports, and an outer portion integral with the inner portion and projecting fowardly therefrom. First and second ramp sections are mounted on one surface of the panel section. The first ramp section has an article-contacting surface extending angularly rearward from the panel section one surface. The second ramp section has an article-contacting surface extending angularly forward from the panel section one surface. The article-contacting surfaces of the ramp sections coact to define an obtuse included angle whereby, when the shelf is in the first mode, the article is supported in an upwardly tilted position by the ramp sections. An end section is provided which extends angularly from the inner edge of the panel section and coacts with support-attaching means provided on said panel section to retain the shelf in either mode in a selected position on the upright supports.

DESCRIPTION

For a more complete understanding of the invention reference is made to the drawings wherein:

FIG. 1 is a fragmentary perspective view of one embodiment of the improved display shelf shown mounted in a first mode on a pair of upright supports and supporting a plurality of articles of rectangular carton form arranged in an upwardly tilted stacked relation.

FIG. 2 is similar to FIG. 1 but showing the shelf in a second mode and supporting the articles of FIG. 1 when arranged in face-to-face upright positions.

FIG. 3 is an enlarged top plan view of the shelf per se when in the second mode.

FIG. 4 is an enlarged side elevational view of the shelf of FIG. 3 when in the second mode.

Figure 5:
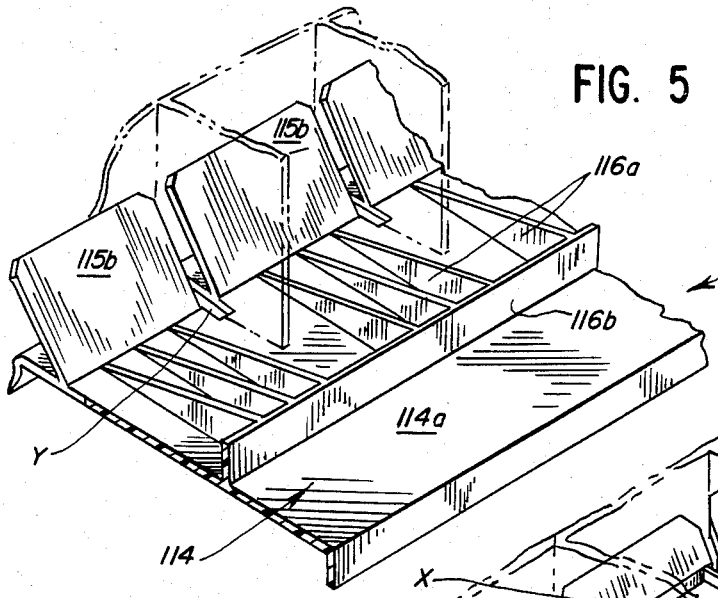
FIG. 5 is a fragmentary perspectivve view of a second embodiment of the improved display shelf; the latter being shown in a first mode.
Figure 6:
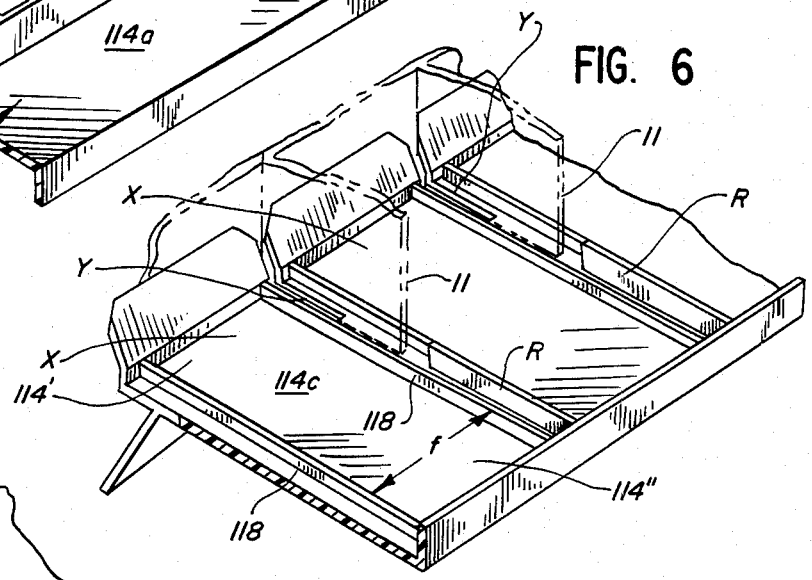
FIG. 6 is similar to FIG. 5 but showing the display shelf in a second mode.

Referring now to the drawings and, more particularly, to FIGS. 1 and 2, one embodiment of the improved shelf 10 is shown mounted in a selected position on a pair of laterally spaced upright supports 11 which form a part of a conventional display assembly 12. The supports 11, in the illustrated assembly are disposed forwardly of the upright back wall 13 of the assembly.

As seen more clearly in FIGS. 3 and 4, the shelf 10 is of one-piece construction and is preferably formed of an inexpensive, yet strong plastic material, such as styrene. Shelf 10 is adapted to assume either of two modes I, II, and includes a panel section 14, a first ramp section 15, and a second ramp section 16, both of which project from one surface **14*a* of the panel section. Extending angularly from the inner or rear edge 14*b* of the panel section 14 is an end section 17. The end section 17 and the rear portion 15*a* of the first ramp section 15 coact with one another and engage the back wall 13 of the display assembly 12** when the shelf is mounted in either mode I or II, as will be described more fully hereinafter.

First ramp section 15 is provided with an article-contacting surface **15*b* which extends rearwardly at an angle (e.g., 45°) from the surface 14*a* of the panel section 14. The second ramp section 16 is located forwardly of the first ramp section 15 and is provided with an article-contacting surface 16*a* which extends forwardly at an angle (e.g. 20°) from the surface 14*a*. Surfaces 15*b* and 16*a* coact with one another to define an obtuse included angle a. The size of the angle a may vary as desired and will depend to a certain extent on the type of article A to be supported by the shelf 10 when it is disposed in a first mode I, see FIG. 1. The forward end 16*b* of the second ramp section 16 is preferably spaced rearwardly from the outer edge of panel section 14**.

Extending angularly from a second surface **14*c* of panel section 14 which is opposite surface 14*a* are laterally spaced guide means 18 which in the illustrated embodiment comprise elongated peripheral flanges between which a plurality of articles A are positioned when the shelf assumes the second mode II, see FIG. 2. The outer ends of the flanges 18 are interconnected by a cross flange 20. The inner or rear ends of the flanges 18 are interconnected by the end section 17. The flanges 18 and 20** serve a dual function: (a) they provide stability for the articles A accommodated by the shelf when in the second mode II and (b) they provide reinforcement for the shelf.

Each flange 18 is provided with a support-attaching means 21 which is disposed forwardly of the end section 17. The support-attaching means, as illustrated, includes an outwardly offset finger 22 which is integral with the flange 18. Spaced rearwardly of finger 22 by an amount slightly greater than the width of support 11 is an outwardly extending protuberance 23, see FIG. 3. The distal end 22*a* of finger 22 is spaced outwardly from the exterior surface of the flange 18 by an amount approximating the thickness of the support 11. It should be noted that the finger 22 and protuberance 23 disposed to one side of the panel section are spaced a greater distance from panel surface 14*c* than on the other side thereof. This space differential permits a single support 11 to be engaged by the attaching means 22 of two adjacent shelves disposed in substantially the same horizontal plane.

In attaching the shelf 10 to the supports 11, the inner end of shelf is inserted between the pair of supports and then the shelf is pushed inwardly toward surface 13 until the end section 17 contacts the surface. Simultaneously therewith the protuberances 23 will slide past the supports and the latter will then slide into place between the ends 22*a* of the fingers 22 and the sides of the panel section.

As seen in FIG. 3, panel section 14 may be provided with a plurality of apertures 14*d* which effectively reduce the overall weight of the shelf, and also facilitate the molding of the shelf.

FIGS. 5–8 disclose a second embodiment of the improved shelf 110. To facilitate understanding of shelf 110, part thereof corresponding to parts of shelf 10 will be given the same identifying numerals, but in a one-hundred series. In shelf 110, the panel section 114 spans the distance between several pairs of adjacent supports 11 rather than just one pair as is the case with shelf 10.

Panel section 114 is provided with an inner portion 114' which is formed into a plurality of like segments X by elongated forwardly extending slots Y arranged in spaced parallel relation. Each slot is adapted to slidably accommodate a complemental slot formed in an upright support 11. Each segment X is disposed between a pair of adjacent supports. The panel section 114 also includes an outer portion 114'' which is integral with the inner portion 114' and projects forwardly of the supports.

Figure 7:
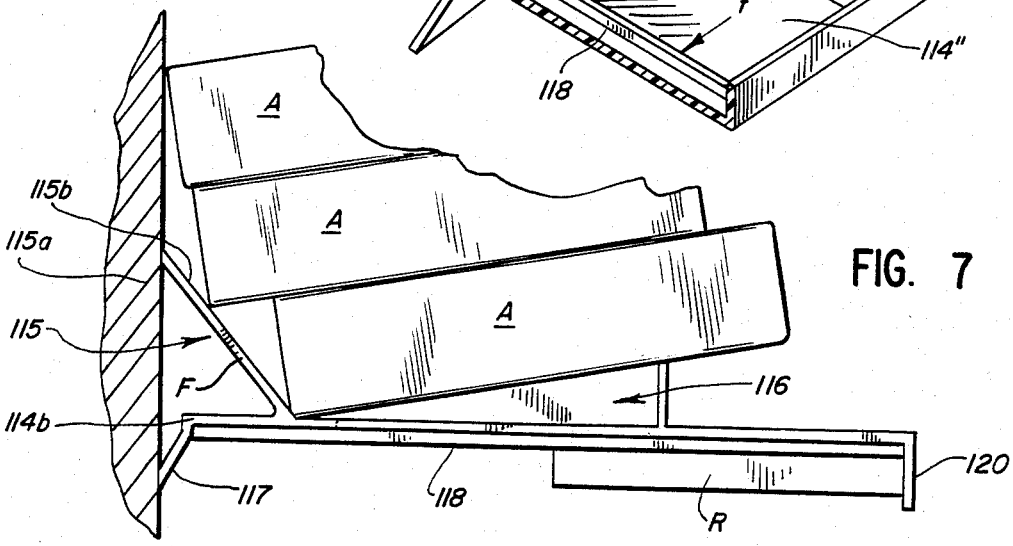
FIGS. 7 and 8 are enlarged fragmentary side elevational views of the display shelf of FIG. 5, but showing the shelf, respectively, in first and second modes with a plurality of articles supported thereby in each mode.
Figure 8:
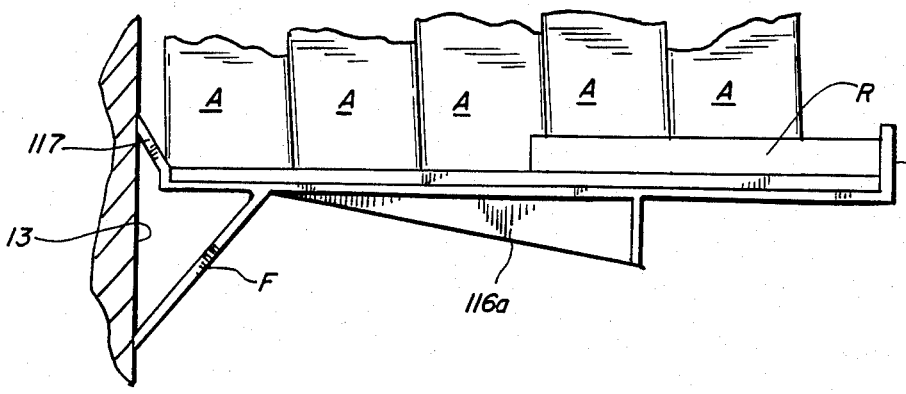

Provided on one surface 114*a* of panel section 114 is a first ramp section 115, which in the illustrated embodiment comprises a rearwardly and angularly extending flange F having an exposed surface 115*b* for contacting the lower articles of a stack of articles supported by the shelf when the latter assumes the first mode I, see FIG. 7. In addition to the first ramp section 115, surface 114*a* of the panel section 114 is provided with a second ramp section 116 which is disposed forwardly of the first ramp section. Ramp section 116 includes a plurality of spaced, substantially parallel, narrow wedge-shape rails 116*a*, each having the upper surface thereof extending angularly forwardly from surface 114*a*. The outer distal ends of the rails are disposed forwardly of the supports 11 and are interconnected to one another by a projecting ledge 116*b* which extends cross-wise of the panel section surface 114*a*. Thus, when the shelf 110 is in the first mode I and is supporting a stack of articles, the first and second ramp sections 115, 116 coact to support the stack in an upwardly tilted position with the lowermost article of the stack being offset forwardly a small amount by the sloping exposed surface 115*b* of the first ramp section 115. The lengths of the rails 116*a* are less than the length of the surface of the lowermost of the stacked articles engaged thereby; thus, the outer end of the lowermost article projects forwardly and upwardly beyond the ledge 116*b*, see FIG. 7, and may be readily grasped and pulled forward and removed from the bottom of the stack without causing disruption of the other articles of the stack.

The second surface 114*c* of the panel section 114 is provided with a plurality of spaced substantially parallel elongated guides 118. There are at least two guides between each pair of upright supports. The spacing f between the guides, disposed between a pair of supports, closely approximates the width of the article and thus, provides stability when the article is supported on its end, see FIG. 8. The guides also serve to reinforce the panel section 114. The outer ends of the guides are interconnected by a peripheral flange 120. For added reinforcement a plurality of elongated stiffening ribs R may be provided on the outer portion 114'' of the panel section 114. Preferably the ribs are in alignment with the slots Y.

While the shelf has been described in relation to supporting articles having a rectangular carton-like configuration, it is not intended to be limited thereto. The slope of the first and second ramp sections and the spacing between the guides or flanges may be varied as desired.

Thus, it will be noted that a simple, inexpensive yet sturdy shelf has been described which may be readily attached to conventional supports without requiring tools or special fastening devices. Furthermore, the improved shelf may assume either of two modes so that the articles may be displayed in two different ways or two different types of articles can be displayed depending upon which mode the shelf is in.

I claim:

1. A removable display shelf adapted to be selectively mounted in either of two modes between at least a pair of spaced, substantially parallel, upright supports, said shelf comprising a panel section for disposition intermediate the upright supports and projecting outwardly therefrom when said shelf is in either mode; an end section disposed at a peripheral segment of the panel section and adapted to engage a supporting member disposed rearwardly of the upright supports when said shelf is mounted in either mode on the upright supports; an angularly and rearwardly extending first ramp section mounted on one surface of said panel section; an angularly and forwardly extending second ramp section mounted on said panel section one surface forwardly of said first ramp section, said first and second ramp sections, when said shelf is in a first mode, coacting to supportingly engage an article in an upwardly tilted position relative to the panel section one surface; and support-engaging means extending outwardly from and spaced from said end section and coacting therewith for retaining said shelf in either mode between the upright supports.

2. The display shelf of claim 1 wherein said panel section includes a second surface opposite said one surface on which laterally spaced elongated substantially parallel peripheral flange guide means projecting angularly from the second surface are provided and said guide means being adapted to supportingly accomodate an article therebetween when said shelf is mounted in a second mode.

3. The display shelf of claim 1 wherein the first ramp section has a rear edge portion which coacts with the end section to form a plane angularly disposed relative to said panel section one surface.

4. The display shelf of claim 1 wherein article-contacting surfaces of said first and second ramp sections define a fixed obtuse included angle adapted to accomodate an article thereon.

5. The display shelf of claim 2 wherein the guide means flange portions have corresponding outer ends interconnected by an angularly extending flange portion.

6. The display shelf of claim 2 wherein the guide means flange portions have corresponding inner ends interconnected by said end section.

7. The display shelf of claim 6 wherein the guide means flange portions have corresponding inner ends interconnected by said end section.

8. The display shelf of claim 1 wherein said second ramp section includes a forwardly positioned fixed ledge segment projecting from the panel section one surface and extending substantially cross-wire thereof, and a fixed substantially wedge-shape segment projecting from the panel section one surface and extending rearwardly from said ledge segment, said wedge-shaped segment having a wide end disposed adjacent said ledge segment, a narrow end disposed adjacent said first ramp section, and an inclined upper surface adapted to supportingly accomodate an article thereon when said shelf is mounted in the first mode.

9. The display shelf of claim 1 being of one-piece construction.

10. The display shelf of claim 2 wherein each guide means flange portion is provided with an outwardly offset support-attaching element, each element being spaced forwardly of said end section.

11. A removable display shelf adapted to be selectively mounted in either of two modes on a plurality of laterally spaced, substantially parallel upright supports, said shelf comprising a panel section having an inner portion for spanning the distance between adjacent upright supports and an outer portion integral with said inner portion for projecting forwardly of the supports, when said shelf assumes either mode, said panel section inner portion being provided with a plurality of segments with each segment being adapted to be disposed intermediate a pair of adjacent upright supports; an end section extending angularly from predetermined segments and adapted to engage a supporting member disposed rearwardly of the upright supports when said shelf is mounted in either mode; first ramp section mounted on one surface of said panel section and extending angularly rearward therefrom between a pair of upright supports; second ramp section mounted on said panel section one surface and forwardly of said first ramp section, said second ramp section extending angularly forward from said one surface, said first and second ramp sections having article-contacting surfaces coacting with one another to form an obtuse included angle; and support-engaging means spaced from said end section and coacting therewith for retaining said shelf in either mode in selected positions on the upright supports.

12. The display shelf of claim 11 wherein adjacent segments of said panel section inner portion are separated from one another by an elongated slot extending forwardly from the inner edge of said panel section inner portion, each slot being adapted to accommodate an upright support when said shelf is mounted thereon in either mode.

13. The display shelf of claim 11 wherein the panel section includes a second surface opposite said one surface and on which laterally spaced guide means are provided, adjacent guide means being adapted to supportingly accommodate an article therebetween, when said shelf is mounted in a second mode.

14. The display shelf of claim 13, wherein a pair of adjacent guide means have portions thereof disposed between adjacent slots.

* * * * *

UNITED STATES PATENT AND TRADEMARK OFFICE

CERTIFICATE OF CORRECTION

PATENT NO. : 4,515,279

DATED : May 7, 1985

INVENTOR(S) : Homer F. King

It is certified that error appears in the above-identified patent and that said Letters Patent is hereby corrected as shown below:

Column 4, line 57, after the word "from" insert

--said panel section--

Signed and Sealed this

*Twelfth* Day of *November 1985*

[SEAL]

*Attest:*

DONALD J. QUIGG

*Attesting Officer*

*Commissioner of Patents and Trademarks*